US011778698B2

(12) United States Patent
Nohara et al.

(10) Patent No.: US 11,778,698 B2
(45) Date of Patent: Oct. 3, 2023

(54) LASER AND INFRARED HEATING DEVICE

(71) Applicant: MITSUBISHI HEAVY INDUSTRIES, LTD., Tokyo (JP)

(72) Inventors: Toshikatsu Nohara, Tokyo (JP); Takashi Shibutani, Tokyo (JP); Shigenari Horie, Tokyo (JP); Makoto Tamura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 168 days.

(21) Appl. No.: 16/639,350

(22) PCT Filed: Aug. 24, 2017

(86) PCT No.: PCT/JP2017/030235
§ 371 (c)(1),
(2) Date: Feb. 14, 2020

(87) PCT Pub. No.: WO2019/038870
PCT Pub. Date: Feb. 28, 2019

(65) Prior Publication Data

US 2020/0221546 A1 Jul. 9, 2020

(51) Int. Cl.

| | |
|---|---|
| ***H05B 3/00*** | (2006.01) |
| ***B05D 3/06*** | (2006.01) |
| ***H05B 1/02*** | (2006.01) |

(52) U.S. Cl.
CPC ..... *H05B 3/0038* (2013.01); *B05D 3/06* (2013.01); *H05B 1/0236* (2013.01); *H05B 2203/032* (2013.01)

(58) Field of Classification Search
CPC .. B62M 6/45; B62M 6/55; B62M 6/50; B05C 9/14; B05D 3/02; B05D 3/06; F26B 3/30;
(Continued)

(56) References Cited

U.S. PATENT DOCUMENTS 5,335,308 A * 8/1994 Sorensen ..... F26B 3/30 356/43
6,217,695 B1 * 4/2001 Goldberg ..... B32B 27/34 427/314

(Continued)

FOREIGN PATENT DOCUMENTS

| | | |
|---|---|---|
| EP | 1874095 | 1/2008 |
| FR | 2675246 | 10/1992 |

(Continued)

OTHER PUBLICATIONS

International Search Report dated Nov. 28, 2017 in corresponding International (PCT) Patent Application No. PCT/JP2017/030235, with English Translation.

(Continued)

*Primary Examiner* — William J Levicky
*Assistant Examiner* — Adam M Eckardt
(74) *Attorney, Agent, or Firm* — Wenderoth, Lind & Ponack, L.L.P.

(57) ABSTRACT

An infrared heating device that appropriately sets positions of infrared lamps and a radiation thermometer relative to an object to be heated and is easily positioned includes: an infrared irradiator that irradiates infrared rays to an object to be heated to heat the object to be heated; a holding member that holds the infrared irradiator; a radiation thermometer that measures a temperature of a surface of the object; and a pair of laser pointers that irradiate laser beams to the surface of the object from different positions. The pair of laser pointers are disposed to cause the respective laser beams to be coincident in position with each other at one point on the surface of the object when a distance between the surface of the object and the infrared irradiator is a predetermined distance.

15 Claims, 13 Drawing Sheets

(58) Field of Classification Search
CPC . F26B 3/28; F26B 3/00; H05B 1/0236; H05B 2203/032; H05B 3/0038; H05B 3/42; H05B 1/02; H05B 3/00; H05B 3/009; G01L 3/04; G01L 5/13; B64F 5/27; B64F 5/00; B64D 15/00; B64D 15/20; E01H 5/08; E01H 5/12
See application file for complete search history.

(56) References Cited

U.S. PATENT DOCUMENTS

| | | | | |
|---|---|---|---|---|
| 6,226,454 | B1 * | 5/2001 | Couture | F26B 3/28 392/419 |
| 2004/0136700 | A1 * | 7/2004 | Yackel | F26B 3/30 392/411 |
| 2006/0291829 | A1 * | 12/2006 | Nelson | F26B 3/30 392/412 |
| 2007/0023661 | A1 * | 2/2007 | Wagner | G02B 5/208 348/E5.09 |
| 2007/0096352 | A1 * | 5/2007 | Cochran | B29C 49/64 264/492 |
| 2007/0297775 | A1 * | 12/2007 | Koren | H01L 21/67115 392/416 |
| 2007/0299558 | A1 * | 12/2007 | Nelson | H05B 3/0052 700/259 |
| 2009/0068376 | A1 * | 3/2009 | Philippi | B29C 64/214 427/532 |
| 2011/0165340 | A1 * | 7/2011 | Baumann | B29C 64/153 427/532 |
| 2012/0261847 | A1 * | 10/2012 | Sirovskiy | B29B 13/023 264/16 |
| 2013/0323936 | A1 * | 12/2013 | Ranish | H05B 3/00 438/795 |
| 2017/0011923 | A1 * | 1/2017 | Tanimura | H01L 21/67115 |
| 2017/0210006 | A1 * | 7/2017 | Takahashi | G02B 27/30 |
| 2020/0221546 | A1 * | 7/2020 | Nohara | H05B 1/0236 |

FOREIGN PATENT DOCUMENTS

| | | |
|---|---|---|
| FR | 2991544 | 12/2013 |
| JP | 6-111922 | 4/1994 |
| JP | 06-178964 | 6/1994 |
| JP | 2005-294243 | 10/2005 |
| JP | 2008-6438 | 1/2008 |

OTHER PUBLICATIONS

Written Opinion of the International Searching Authority dated Nov. 28, 2017 in corresponding International (PCT) Patent Application No. PCT/JP2017/030235, with English Translation.
Extended European Search Report dated Jun. 8, 2020 in corresponding European Patent Application No. 17922710.3.

* cited by examiner

LASER AND INFRARED HEATING DEVICE

TECHNICAL FIELD

The present invention relates to an infrared heating device that promotes drying and curing by heating through irradiation of infrared rays.

BACKGROUND ART

An infrared heating device that measures temperature of an object to be heated by a noncontact temperature sensor (radiation thermometer) to control an infrared irradiation heater is well-known (PTL 1).

CITATION LIST

Patent Literature

[PTL 1] Japanese Unexamined Patent Application, Publication No. H6-178964

SUMMARY OF INVENTION

Technical Problem

In manufacture and operation of an aircraft, partial repair coating at each position of an airframe and sealant application in replacement of an antenna part are necessary. In the application, after the coating and the sealant in a flowing state are applied, drying and curing are necessary for solidification, and natural drying takes a long time. As a method to reduce the curing and drying time of the coating and the sealant, a method using hot air or infrared rays is well-known. The drying time is reduced as a heating temperature is higher; however, an upper limit of the heating temperature is determined in order to secure performance of an object to be heated in the aircraft. Accordingly, to minimize the drying time, temperature control with high accuracy that keeps the temperature as high as possible within a range not exceeding the upper limit of the heating upper temperature is necessary.

As the method to perform the temperature control with high accuracy, direct measurement of the object to be heated by a contact thermometer is common; however, a coated surface and a sealant cured product have appearance requirements, and the above-described method leaving a contact trace is not applicable. Therefore, as a method to measure the temperature in a noncontact manner, application of a radiation thermometer is considered. In the infrared heating, however, a wavelength of an infrared lamp and a measurement wavelength of the radiation thermometer are close to each other. Therefore, there is a problem that, for example, an error tends to become larger as output of the infrared lamp is higher. Such issues are described with reference to FIG. 10 and FIGS. 11A to 11C.

For example, as illustrated in FIG. 10, a conventional infrared heating device using the radiation thermometer includes two sets of reflectors 32 in which respective infrared lamps 31 are internally disposed, and a radiation thermometer 33 provided between the two sets of infrared lamps 31 and reflectors 32. The radiation thermometer 33 is disposed at a position facing a region R1 where infrared rays IR from the two sets of infrared lamps 31 and reflectors 32 are overlapped, in order to measure the highest reachable temperature of an object to be heated T.

In the configuration illustrated in FIG. 10, when a distance DI between each of the infrared lamps 31 and the object to be heated T is long, the object to be heated T is hardly warmed, and the output of the infrared lamps 31 is increased. This causes large error of the radiation thermometer 33 and steady-state deviation (see FIG. 11A). In contrast, when the distance DI is extremely short, the object to be heated T is easily warmed, and hunting in which the temperature control sensitively reacts occurs (see FIG. 11B).

Accordingly, to perform stable temperature control with high accuracy by the infrared heating device using the radiation thermometer as illustrated in FIG. 11C, it is necessary to appropriately set the positions of the infrared lamps and the radiation thermometer relative to the object to be heated.

In particular, in the case of the aircraft, the repair coating and sealant application for an upper part of the airframe are performed at a high place. Therefore, it is desirable that the infrared heating device be directly installable on the airframe and be easily positioned.

The present invention is made in consideration of the above-described issues, and an object of the present invention is to provide an infrared heating device that appropriately sets the positions of the infrared lamps and the radiation thermometer relative to the object to be heated and is easily positioned.

Solution to Problem

An infrared heating device according to a first invention to solve the above-described issues includes: an infrared irradiation means that irradiates infrared rays to an object to be heated to heat the object to be heated; a holding member that holds the infrared irradiation means; a noncontact temperature measurement means that is attached to the holding member and measures temperature of a surface of the object to be heated; and at least one pair of laser beam irradiation means that are attached to the holding member and irradiate laser beams to the surface of the object to be heated from different positions, in which the paired laser beam irradiation means are disposed to cause the respective laser beams to be coincident in position with each other at one point on the surface of the object to be heated when a distance between the surface of the object to be heated and the infrared irradiation means is a predetermined distance.

In an infrared heating device according to a second invention to solve the above-described issues, in the infrared heating device according to the above-described first invention, each of the laser beam irradiation means is attached to the holding member while being supported by a support plate that adjusts a support angle of the laser beam irradiation means, and the support angle is changed when the predetermined distance is changed.

In an infrared heating device according to a third invention to solve the above-described issues, in the infrared heating device according to the above-described first or second invention, the noncontact temperature measurement means is attached to the holding member to cause a measurement direction of the noncontact temperature measurement means to be parallel to a main irradiation direction of the infrared rays, and the laser beam irradiation means are disposed to cause all of the laser beams to be coincident in position with one another at one point where the surface of the object to be heated and the measurement direction intersect with each other when the distance is the predetermined distance.

In an infrared heating device according to a fourth invention to solve the above-described issues, the infrared heating device according to the above-described first or second invention includes a plurality of pairs of the laser beam irradiation means, and the plurality of pairs of the laser beam irradiation means are disposed to cause the laser beams in each of the pairs to be coincident in position with each other at one point on the surface of the object to be heated different for each pair when the distance is the predetermined distance.

In an infrared heating device according to a fifth invention to solve the above-described issues, in the infrared heating device according to any one of the above-described first to fourth inventions, the infrared irradiation means includes an infrared lamp that emits infrared rays and a reflector that reflects the infrared rays from the infrared lamp, and at least one pair of the laser beam irradiation means is attached to the reflector.

Advantageous Effects of Invention

According to the present invention, the positions of the infrared irradiation means and the noncontact temperature measurement means relative to the object to be heated can be appropriately set and positioning is easily performable by using the pair of laser beam irradiation means. Accordingly, it is possible to perform stable temperature control with high accuracy. As a result, the work time for drying and curing by infrared heating can be reduced, which makes it possible to improve work efficiency.

DESCRIPTION OF EMBODIMENTS

Some embodiments of an infrared heating device according to the present invention are described below with reference to drawings. Note that two straight-tube lamps arranged in parallel are illustrated as infrared lamps of the infrared heating device; however, the arrangement, the number, and the shape of the infrared lamps are not limited thereto in the present invention, and any arrangement, number, and shape are applicable. Further, reflectors are also suitably changeable based on the arrangement, the number, and the shape of the infrared lamps.

Example 1

Figure 1:
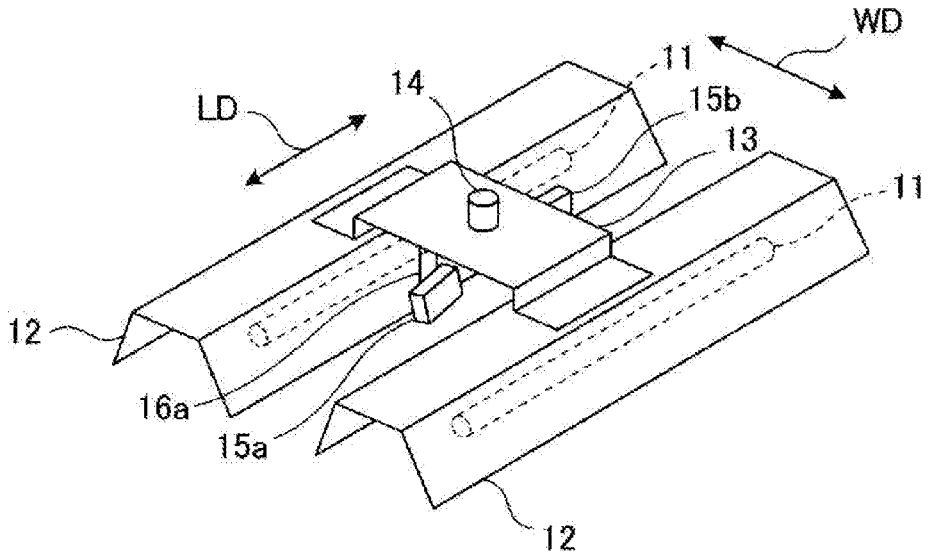
FIG. 1 is a perspective view illustrating an exemplary embodiment (Example 1) of an infrared heating device according to the present invention.
Figure 2A:
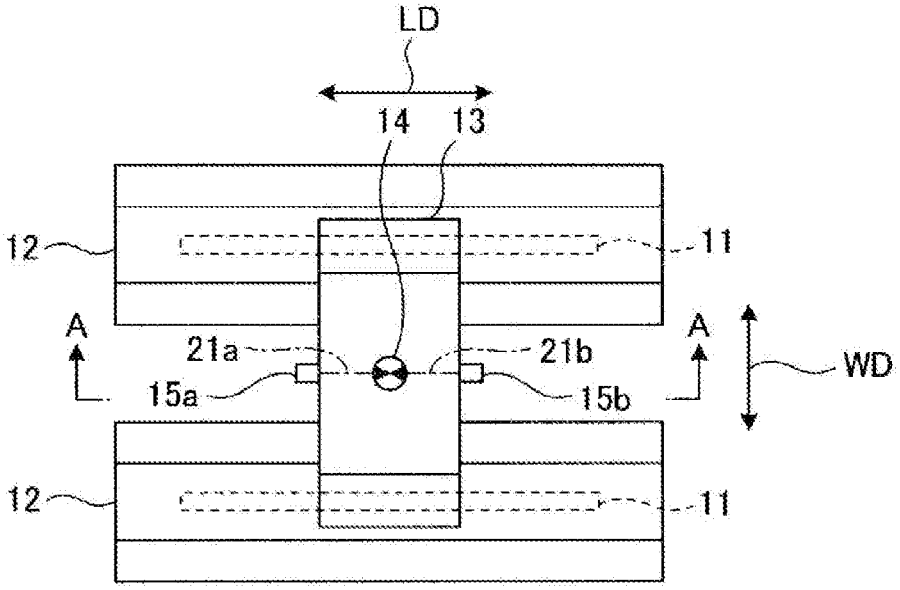
FIG. 2A is a top view of the infrared heating device illustrated in FIG. 1.
Figure 2B:
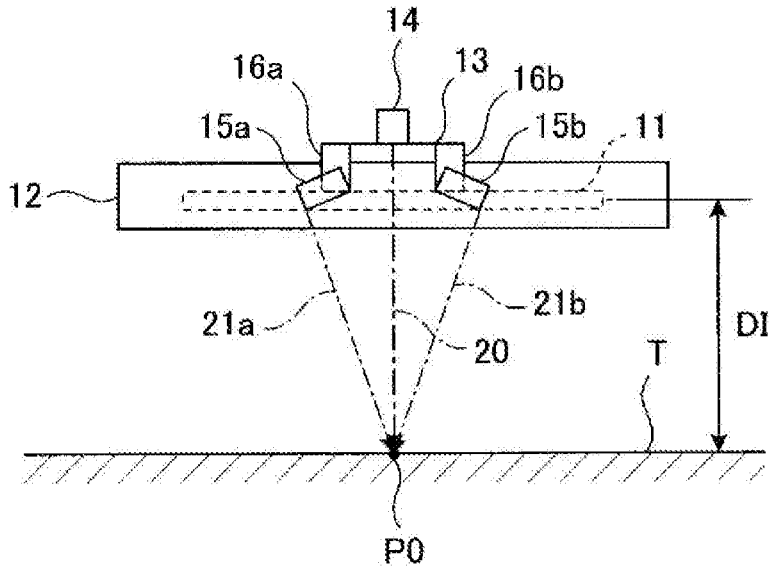
FIG. 2B is a diagram of the infrared heating device as viewed from an arrow direction of line A-A illustrated in FIG. 2A.
Figure 2C:
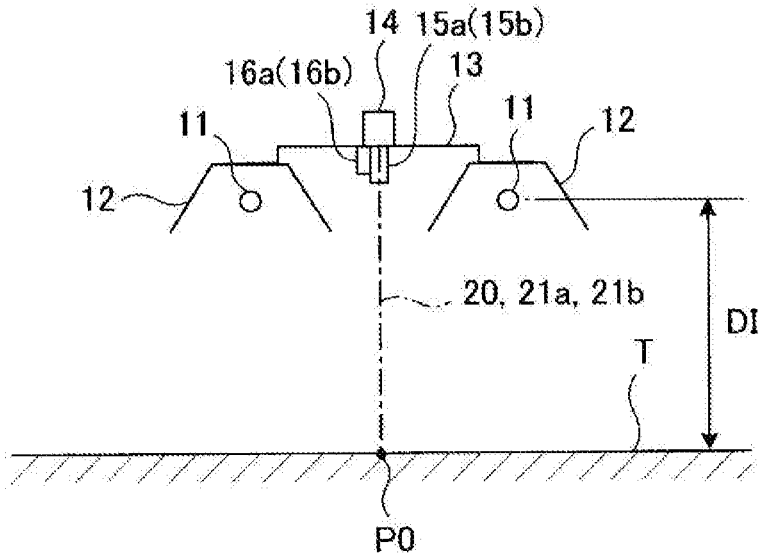
FIG. 2C is a side view of the infrared heating device illustrated in FIG. 2A.
Figure 3A:
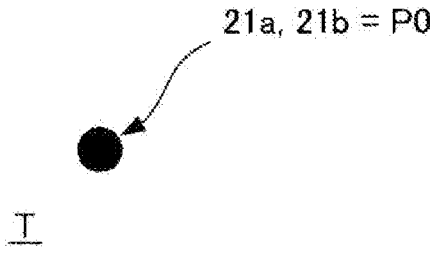
FIG. 3A is a diagram illustrating laser beams from laser pointers in a case of an appropriate position.
Figure 3B:
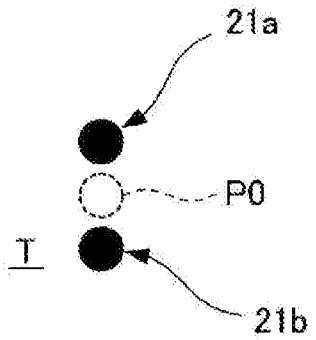
FIG. 3B is a diagram illustrating the laser beams from the laser pointers in a case of an inappropriate position.

FIG. 1 is a perspective view illustrating an infrared heating device according to the present Example, FIG. 2A is a top view of the infrared heating device illustrated in FIG. 1, FIG. 2B is a diagram of the infrared heating device as viewed from an arrow direction of line A-A illustrated in FIG. 2A, and FIG. 2C is a side view of the infrared heating device illustrated in FIG. 2A. Further, FIG. 3A is a diagram illustrating laser beams from laser pointers in a case of an appropriate position, and FIG. 3B is a diagram illustrating the laser beams from the laser pointers in a case of an inappropriate position.

As illustrated in FIG. 1 and FIGS. 2A to 2C, the infrared heating device according to the present Example includes two straight-tube infrared lamps 11 (infrared irradiation means) arranged in parallel, two reflectors 12 (infrared irradiation means) in which the respective infrared lamps 11 are internally disposed, a holding member 13 that is provided at a center in a longitudinal direction LD of the infrared lamps 11 and the reflectors 12 between the two reflectors 12 and holds the two reflectors 12, and a radiation thermometer 14 (noncontact temperature measurement means) provided at a center of the holding member 13.

The infrared lamps 11 emit infrared rays to irradiate the infrared rays to an object to be heated T. The reflectors 12 reflect the infrared rays from the respective infrared lamps 11 to irradiate the infrared rays to the object to be heated T.

The object to be heated T is heated by these infrared rays. In the present Example, the reflectors 12 hold the respective infrared lamps 11, and the holding member 13 indirectly holds the infrared lamps; however, in a case where no reflector 12 is provided, the holding member 13 may directly hold the infrared lamps 11.

An irradiation direction of the infrared rays is not uniquely determined when a light source is a single point light source or a single linear light source; however, in a case where the reflector or the like is provided, the main irradiation direction, for example, a direction as a center of an irradiation range is determined. Therefore, in the following, the direction is referred to as a main irradiation direction.

To measure the highest reachable temperature of a surface of the object to be heated T, the radiation thermometer 14 is disposed at a position facing a point P0 that is a position where the temperature becomes the highest on the surface of the object to be heated T by the infrared rays from the two sets of the infrared lamps 11 and the reflectors 12. For example, in the present Example, the radiation thermometer 14 is disposed at the position facing the point P0 in a region where the infrared rays from the two sets of the infrared lamps 11 and the reflectors 12 are overlapped. When a direction measured by the radiation thermometer 14 is a measurement direction 20, the point P0 is located on the measurement direction 20. The measurement direction 20 is a perpendicular line from the radiation thermometer 14 to the surface of the object to be heated T, and is parallel to the above-described main irradiation direction.

Note that, although illustration is omitted, the holding member 13 is movably supported by, for example, an arm or a link mechanism installed on the surface of the object to be heated T, and the infrared heating device according to the present Example is movable to an optional position on the object to be heated T.

Figure 10:
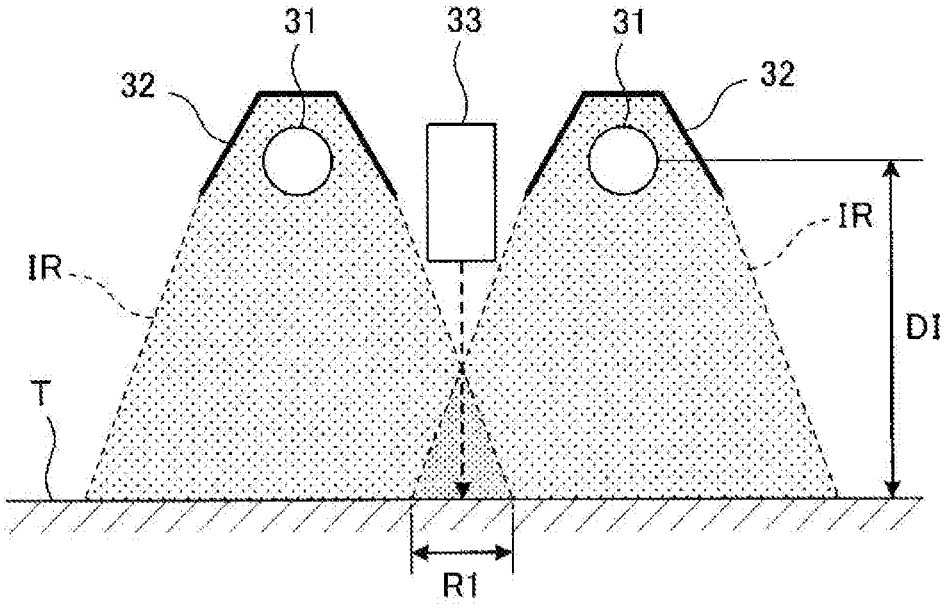
FIG. 10 is a schematic view to explain a conventional infrared heating device using a radiation thermometer.
Figure 11A:
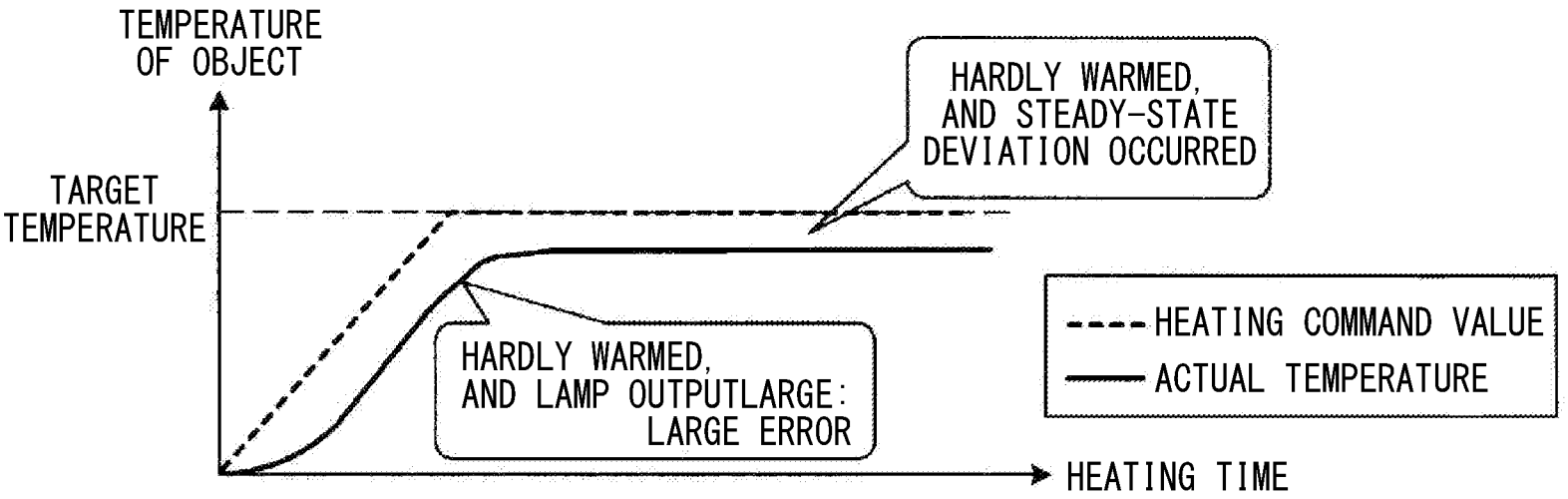
FIG. 11A is a graph to explain temperature control characteristics in a case where a distance between an infrared lamp and an object to be heated is long.
Figure 11B:
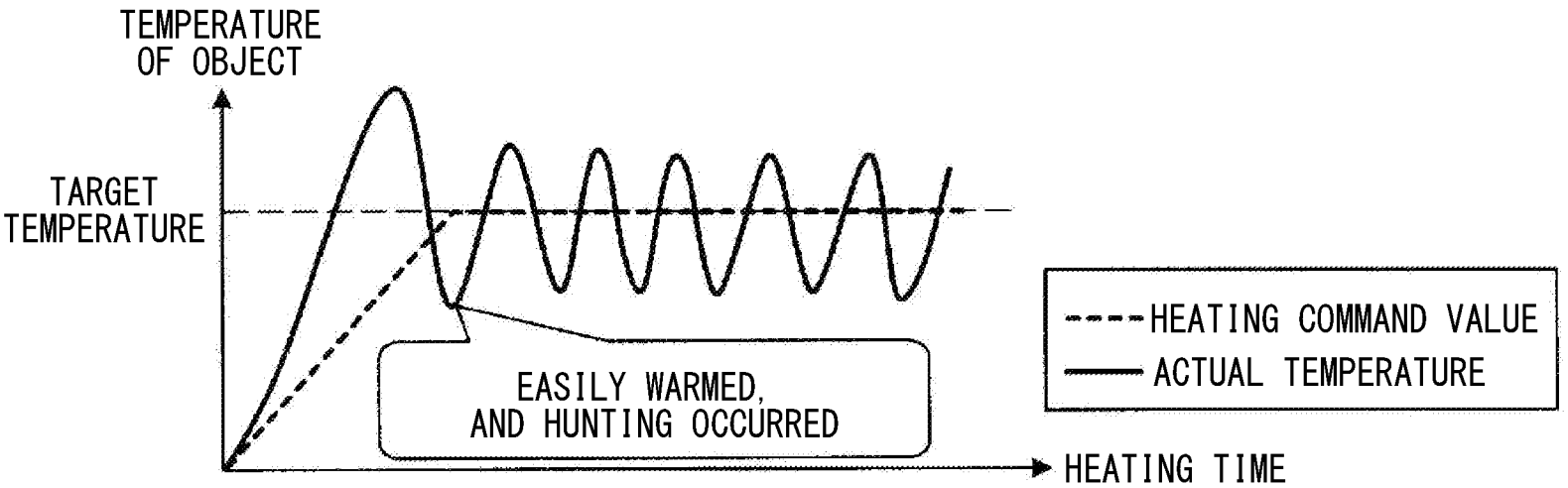
FIG. 11B is a graph to explain the temperature control characteristics in a case where the distance between the infrared lamp and the object to be heated is extremely short.
Figure 11C:
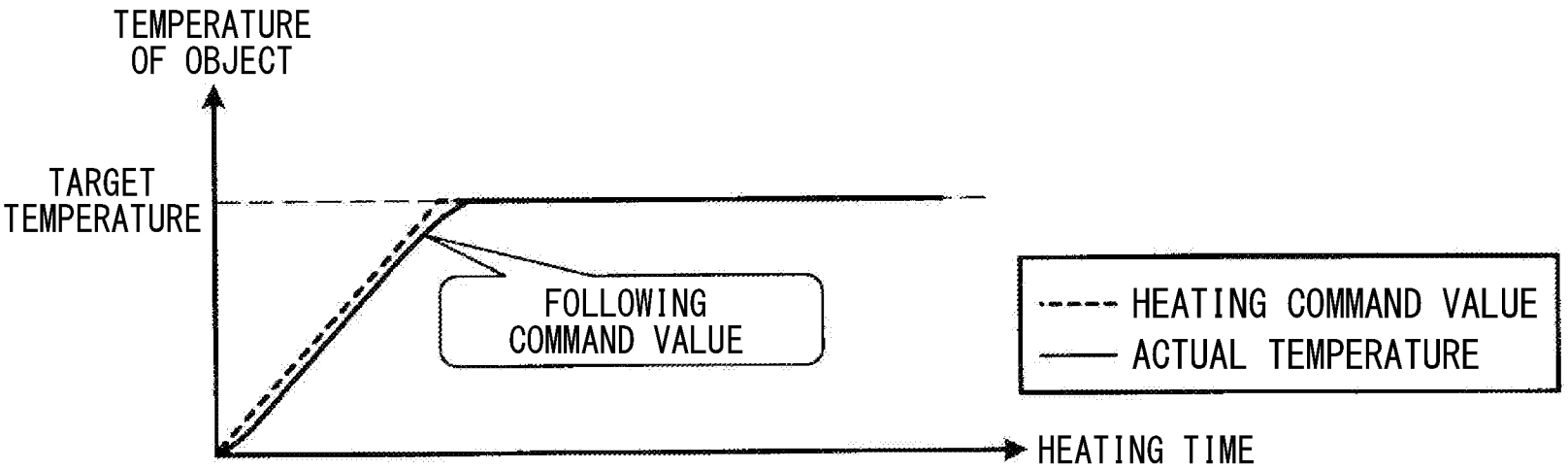
FIG. 11C is a graph to explain the temperature control characteristics in a case where the distance between the infrared lamp and the object to be heated is appropriate.

The configuration as described above is substantially the same as the configuration of the existing infrared heating device illustrated in FIG. 10. The infrared heating device according to the present Example, however, includes a pair of laser pointers 15*a* and 15*b* (laser beam irradiation means) in order to appropriately set the positions of the infrared lamps 11 and the radiation thermometer 14 relative to the object to be heated T.

The laser pointers 15*a* and 15*b* are attached, through support plates 16*a* and 16*b*, to both ends of the holding member 13 in the longitudinal direction LD with the radiation thermometer 14 as a center, so as to be arranged in line symmetry with each other about the above-described measurement direction 20. Further, the support plates 16*a* and 16*b* respectively support the laser pointers 15*a* and 15*b* such that support angles of the laser pointers 15*a* and 15*b* are adjustable. With such a configuration, the laser pointers 15*a* and 15*b* respectively irradiate laser beams 21*a* and 21*b* to the surface of the object to be heated T from different positions.

The laser pointers 15*a* and 15*b* are respectively supported by the support plates 16*a* and 16*b* while the support angles of the laser pointers 15*a* and 15*b* are adjusted such that the laser beam 21*a* from the laser pointer 15*a* and the laser beam 21*b* from the laser pointer 15*b* are coincident in position with (intersect with) each other at one point on the surface of the object to be heated T when a distance DI from each of the infrared lamps 11 to the object to be heated T is an appropriate predetermined distance (distance establishing appropriate positional relationship). In a case where it is necessary to change the appropriate predetermined distance based on work contents, it is sufficient to change the appropriate predetermined distance by adjusting the support angles of the laser pointers 15*a* and 15*b*.

As described above, in the present Example, the laser beam 21*a* and the laser beam 21*b* are made coincident in position with each other at one point on the surface of the object to be heated T. In this case, the laser beam 21*a* and the laser beam 21*b* are made coincident in position with each other at the point P0, and the radiation thermometer 14 is disposed just above the point P0. In other words, the distance DI is set to the appropriate predetermined distance at the point P0 on the surface of the object to be heated T just below the radiation thermometer 14.

Accordingly, when the height positions of the infrared lamps 11 and the reflectors 12 are adjusted by the arm, the link mechanism, or the like supporting the holding member 13 and the distance DI is the appropriate predetermined distance, the laser beam 21*a* and the laser beam 21*b* are coincident in position with each other at the one point (point P0) on the surface of the object to be heated T, as illustrated in FIG. 3A. In contrast, when the distance DI is not the appropriate predetermined distance (distance is short or long), the laser beam 21*a* and the laser beam 21*b* are not coincident in position with each other as illustrated in FIG. 3B.

In other words, when the height positions of the infrared lamps 11 and the reflectors 12 are adjusted to cause the laser beam 21*a* and the laser beam 21*b* to be coincident in position with each other at the one point on the surface of the heated to be heated T, it is possible to easily adjust the distance DI to the appropriate predetermined distance without measuring the distance DI by a measurement device that measures a distance. The distance DI can be set to the appropriate predetermined distance in the above-described manner. Accordingly, the output of the infrared lamps 11 in heating can be suppressed to an appropriate output, which makes it possible to reduce error of the radiation thermometer 14 and to control temperature with high accuracy.

As a result, in a case where the infrared heating device according to the present Example is used for repair coating and sealant application of an aircraft, it is possible to reduce a time waiting for coating drying and sealant curing, and to improve work efficiency.

Example 2

Figure 4A:
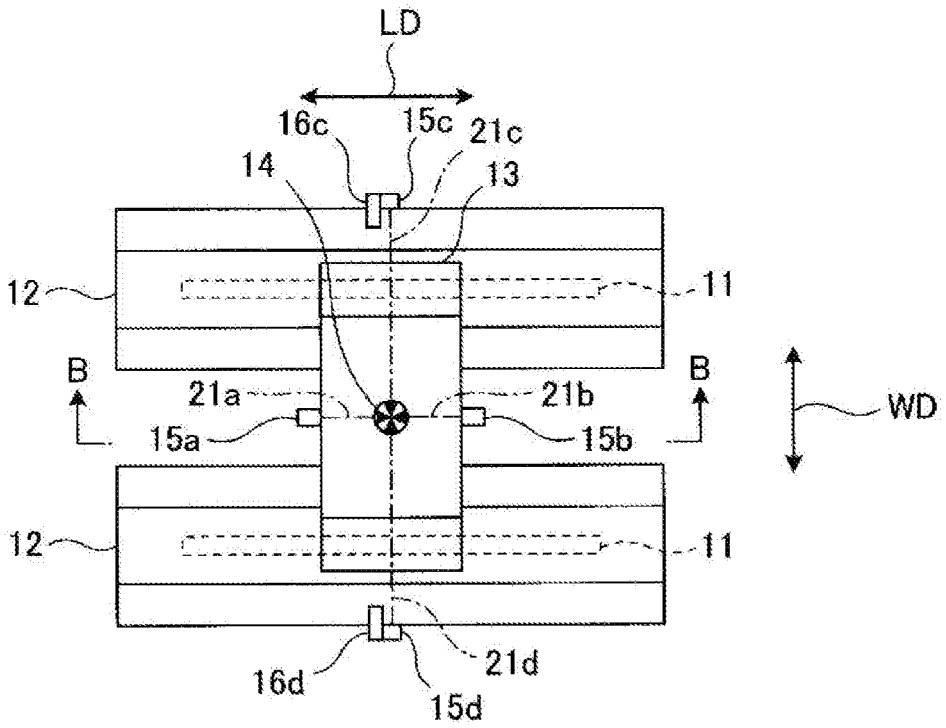
FIG. 4A is a top view illustrating another exemplary embodiment (Example 2) of the infrared heating device according to the present invention.
Figure 4B:
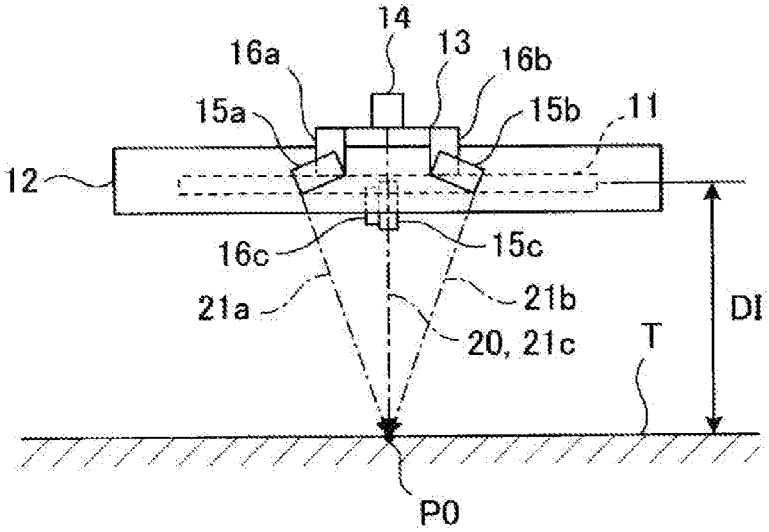
FIG. 4B is a diagram of the infrared heating device as viewed from an arrow direction of line B-B illustrated in FIG. 4A.
Figure 4C:
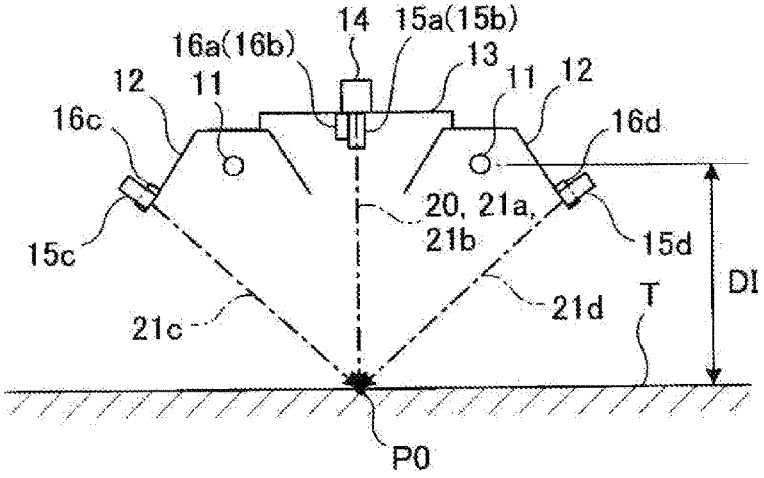
FIG. 4C is a side view of the infrared heating device illustrated in FIG. 4A.
Figure 5A:
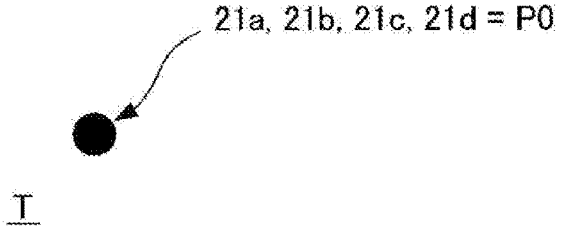
FIG. 5A is a diagram illustrating laser beams from laser pointers in a case of an appropriate position.
Figure 5B:
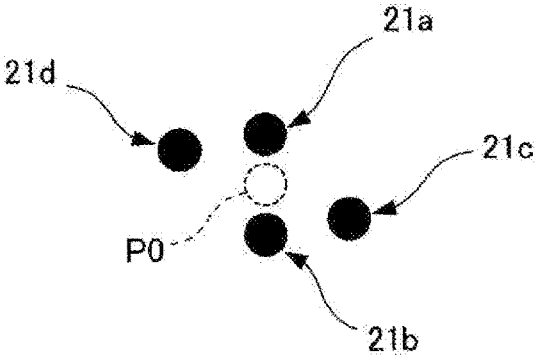
FIG. 5B is a diagram illustrating the laser beams from the laser pointers in a case of an inappropriate position.

FIG. 4A is a top view illustrating an infrared heating device according to the present Example, FIG. 4B is a diagram of the infrared heating device as viewed from an arrow direction of line B-B illustrated in FIG. 4A, and FIG. 4C is a side view of the infrared heating device illustrated in FIG. 4A. Further, FIG. 5A is a diagram illustrating laser beams from laser pointers in a case of an appropriate position, and FIG. 5B is a diagram illustrating the laser beams from the laser pointers in a case of an inappropriate position.

The infrared heating device according to the present Example basically has a configuration equivalent to the configuration of the infrared heating device described in the above-described Example 1. Therefore, in the present Example, components equivalent to the components of the infrared heating device described in the Example 1 are denoted by the same reference numerals, and repetitive description thereof is omitted.

The infrared heating device according to the present Example includes another pair of laser pointers 15*c* and 15*d* (laser beam irradiation means) in addition to the pair of laser pointers 15*a* and 15*b* in order to appropriately set the positions of the infrared lamps 11 and the radiation thermometer 14 relative to the object to be heated T.

The pair of laser pointers 15*a* and 15*b* is attached in a manner similar to the Example 1. The other pair of laser pointers 15*c* and 15*d* are attached, through support plates 16*c* and 16*d*, to both ends of the two reflectors 12 in a width direction WD with the radiation thermometer 14 as a center, so as to be arranged in line symmetry with each other about the above-described measurement direction 20. Further, the support plates 16*c* and 16*d* respectively support the laser pointers 15*c* and 15*d* such that support angles of the laser pointers 15*c* and 15*d* are adjustable. With such a configuration, in addition to the laser pointers 15*a* and 15*b*, the laser pointers 15*c* and 15*d* also respectively irradiate laser beams 21*c* and 21*d* to the surface of the object to be heated T from different positions. Note that the laser pointers 15*c* and 15*d* may be attached to equivalent positions of the holding member 13 by, for example, changing the size or the shape of the holding member 13.

The other pair of laser pointers 15*c* and 15*d* are also respectively supported by the support plates 16*c* and 16*d* while the support angles of the laser pointers 15*c* and 15*d* are adjusted such that the laser beam 21*c* from the laser pointer 15*c* and the laser beam 21*d* from the laser pointer 15*d* are coincident in position with (intersect with) each other at the above-described point in addition to positional coincidence of the laser beam 21*a* and the laser beam 21*b* at one point on the surface of the object to be heated T, namely, such that the laser beams 21*a*, 21*b*, 21*c*, and 21*d* are coincident in position with one another at the one point, when the distance DI is the appropriate predetermined distance. In the case where it is necessary to change the appropriate predetermined distance based on the work contents, it is sufficient to change the appropriate predetermined distance by adjusting the support angles of the laser pointers 15*c* and 15*d* together with the laser pointers 15*a* and 15*b*.

As described above, in the present Example, the laser beams 21*a*, 21*b*, 21*c*, and 21*d* are made coincident in position with one another at the one point on the surface of the object to be heated T. In this Example, the laser beams 21*a*, 21*b*, 21*c*, and 21*d* are made coincident in position with one another at the point P0, and the radiation thermometer 14 is disposed just above the point P0. In other words, the distance DI is set to the appropriate predetermined distance at the point P0 on the surface of the object to be heated T just below the radiation thermometer 14.

Accordingly, when the height positions of the infrared lamps 11 and the reflectors 12 are adjusted by the arm, the link mechanism, or the like supporting the holding member 13 and the distance DI is the appropriate predetermined distance, the laser beams 21*a*, 21*b*, 21*c*, and 21*d* are coincident in position with one another at the one point (point P0) on the surface of the object to be heated T as illustrated in FIG. 5A. In contrast, when the distance DI is not the appropriate predetermined distance (distance is short or long), the laser beams 21*a*, 21*b*, 21*c*, and 21*d* are not coincident in position with one another as illustrated in FIG. 5B.

In other words, when the height positions of the infrared lamps 11 and the reflectors 12 are adjusted to cause the laser beams 21*a*, 21*b*, 21*c*, and 21*d* to be coincident in position with one another at the one point on the surface of the object to be heated T, it is possible to easily adjust the distance DI to the appropriate predetermined distance without measuring the distance DI by a measurement device that measures a distance. The distance DI can be set to the appropriate predetermined distance in the above-described manner. Accordingly, the output of the infrared lamps 11 in heating can be suppressed to an appropriate output, which makes it possible to reduce error of the radiation thermometer 14 and to control temperature with high accuracy. As a result, as with the Example 1, it is possible to improve work efficiency in the coating drying and the sealant curing.

Example 3

Figure 6A:
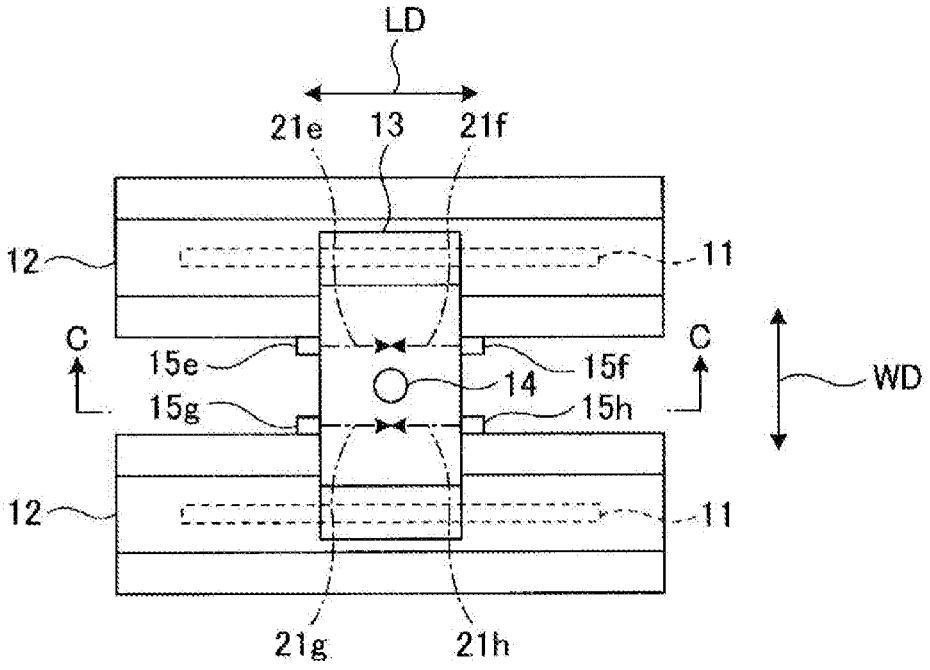
FIG. 6A is a top view illustrating still another exemplary embodiment (Example 3) of the infrared heating device according to the present invention.
Figure 6B:
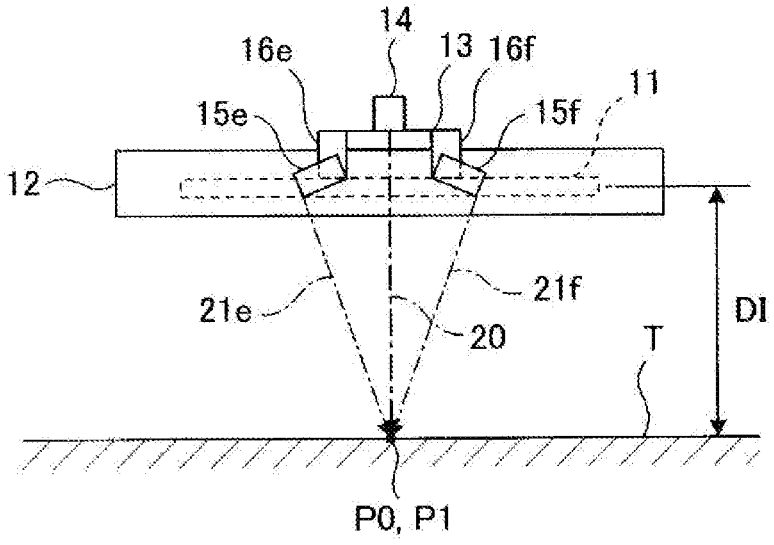
FIG. 6B is a diagram of the infrared heating device as viewed from an arrow direction of line C-C illustrated in FIG. 6A.
Figure 6C:
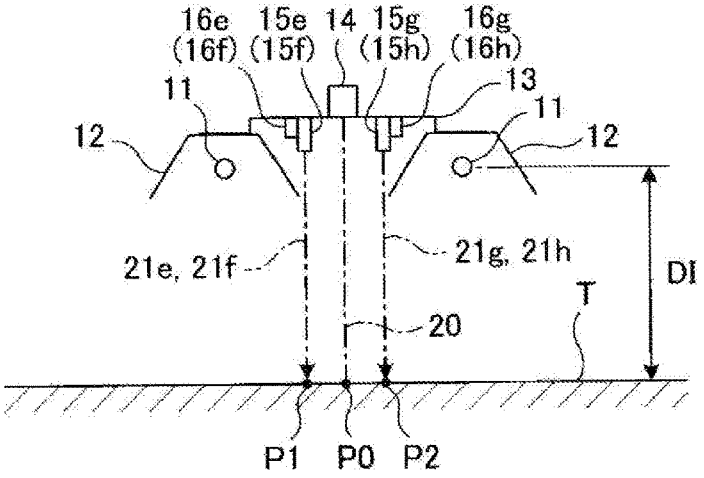
FIG. 6C is a side view of the infrared heating device illustrated in FIG. 6A.
Figure 7A:
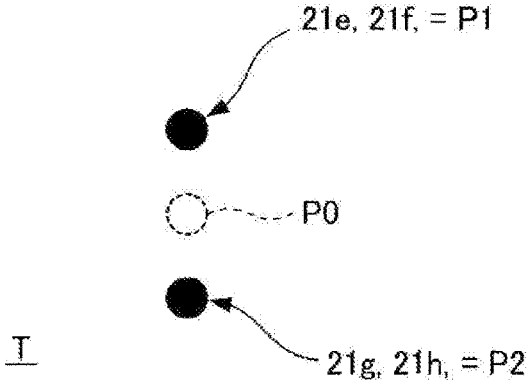
FIG. 7A is a diagram illustrating laser beams from laser pointers in a case of an appropriate position.
Figure 7B:
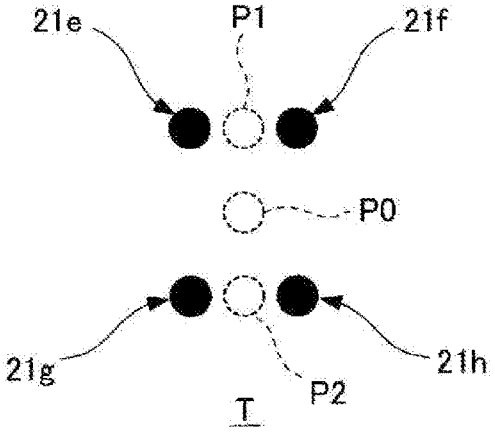
FIG. 7B is a diagram illustrating the laser beams from the laser pointers in a case of an inappropriate position.

FIG. 6A is a top view illustrating an infrared heating device according to the present Example, FIG. 6B is a diagram of the infrared heating device as viewed from an arrow direction of line C-C illustrated in FIG. 6A, and FIG. 6C is a side view of the infrared heating device illustrated in FIG. 6A. Further, FIG. 7A is a diagram illustrating laser beams from laser pointers in a case of an appropriate position, and FIG. 7B is a diagram illustrating the laser beams from the laser pointers in a case of an inappropriate position.

The infrared heating device according to the present Example also basically has a configuration equivalent to the configuration of the infrared heating device described in each of the above-described Examples 1 and 2. Therefore, in the present Example, components equivalent to the components of the infrared heating device described in each of the Examples 1 and 2 are denoted by the same reference numerals, and repetitive description thereof is omitted.

The infrared heating device according to the present Example includes two pairs of laser pointers 15*e*, 15*f*, 15*g*, and 15*h* (laser beam irradiation means) in order to appropriately set the positions of the infrared lamps 11 and the radiation thermometer 14 relative to the object to be heated T.

One pair of laser pointers 15*e* and 15*f* is attached, through support plates 16*e* and 16*f*, to both ends of the holding member 13 in the longitudinal direction LD on a side closer to one of the reflectors 12, so as to be arranged in surface symmetry with each other about a surface passing through the above-described measurement direction 20. The other pair of laser pointers 15*g* and 15*h* is attached, through support plates 16*g* and 16*h*, to both ends of the holding member 13 in the longitudinal direction LD on a side closer to the other reflector 12, so as to be arranged in surface symmetry with each other about the surface passing through the above-described measurement direction 20. Further, the support plates 16*e*, 16*f*, 16*g*, and 16*h* respectively support the laser pointers 15*e*, 15*f*, 15*g*, and 15*h* such that support angles of the laser pointers 15*e*, 15*f*, 15*g*, and 15*h* are adjustable. With such a configuration, the laser pointers 15*e*, 15*f*, 15*g*, and 15*h* respectively irradiate laser beams 21*e*, 21*f*, 21*g*, and 21*h* to the surface of the object to be heated T from different positions.

The laser pointers 15*e* and 15*f* are respectively supported by the support plates 16*e* and 16*f* while the support angles of the laser pointers 15*e* and 15*f* are adjusted such that the laser beam 21*e* from the laser pointer 15*e* and the laser beam 21*f* from the laser pointer 15*f* are coincident in position with (intersect with) each other at a point P1 on the surface of the object to be heated T when the distance DI is the appropriate predetermined distance. Likewise, the laser pointers 15*g* and 15*h* are also respectively supported by the support plates 16*g* and 16*h* while the support angles of the laser pointers 15*g* and 15*h* are adjusted such that the laser beam 21*g* from the laser pointer 15*g* and the laser beam 21*h* from the laser pointer 15*h* are coincident in position with (intersect with) each other at a point P2 on the surface of the object to be heated T when the distance DI is the appropriate predetermined distance. In the case where it is necessary to change the appropriate predetermined distance based on the work contents, it is sufficient to change the appropriate predetermined distance by adjusting the support angles of the laser pointers 15*e*, 15*f*, 15*g*, and 15*h*.

As described above, in the present Example, the laser beam 21*e* and the laser beam 21*f* are made coincident in position with each other at the point P1 on the surface of the object to be heated T, and the laser beam 21*g* and the laser beam 21*h* are made coincident in position with each other at the other point P2 on the surface of the object to be heated T. In other words, the distance DI is set to the appropriate predetermined distance at the two points P1 and P2 different for each pair.

Accordingly, when the positions of the infrared lamps 11 and the reflectors 12 are adjusted by the arm, the link mechanism, or the like supporting the holding member 13 and the distance DI is the appropriate predetermined distance, the laser beam 21*e* and the laser beam 21*f* are coincident in position with each other at the point P1 and the laser beam 21*g* and the laser beam 21*h* are coincident in position with each other at the point P2 on the surface of the object to be heated T, as illustrated in FIG. 7A. In contrast, when the distance DI is not the appropriate predetermined distance (distance is short or long), the laser beam 21*e* and the laser beam 21*f* are not coincident in position with each other on the surface of the object to be heated T, and the laser beam 21*g* and the laser beam 21*h* are not coincident in position with each other on the surface of the object to be heated T, as illustrated in FIG. 7B.

In other words, when the positions of the infrared lamps 11 and the reflectors 12 are adjusted to cause the laser beam 21*e* and the laser beam 21*f* to be coincident in position with each other at the point P1 on the surface of the object to be heated T and to cause the laser beam 21*g* and the laser beam 21*h* to be coincident in position with each other at the point P2 on the surface of the object to be heated T, it is possible to easily adjust the distance DI to the appropriate predetermined distance without measuring the distance DI by a measurement device that measures a distance.

In addition, since the distance D1 is set to the appropriate predetermined distance at the two points P1 and P2 on the surface of the object to be heated T, the infrared lamps 11 and the reflectors 12 are arranged in parallel to an axis that passes through the point P1 and the point P2 on the surface of the object to be heated T. In other words, a predetermined axis direction (for example, longitudinal direction LD or width direction WD) of the infrared lamps 11 and the reflectors 12 can be arranged in parallel to the surface of the object to be heated T.

As described above, the distance DI can be set to the appropriate predetermined distance, and the predetermined axis direction of the infrared lamps 11 and the reflectors 12 is arranged in parallel to the surface of the object to be heated T. Accordingly, the output of the infrared lamps 11 in heating can be suppressed to an appropriate output, which makes it possible to reduce error of the radiation thermometer 14 and to control temperature with high accuracy. As a result, as with the Examples 1 and 2, it is possible to improve work efficiency in the coating drying and the sealant curing.

Example 4

Figure 8A:
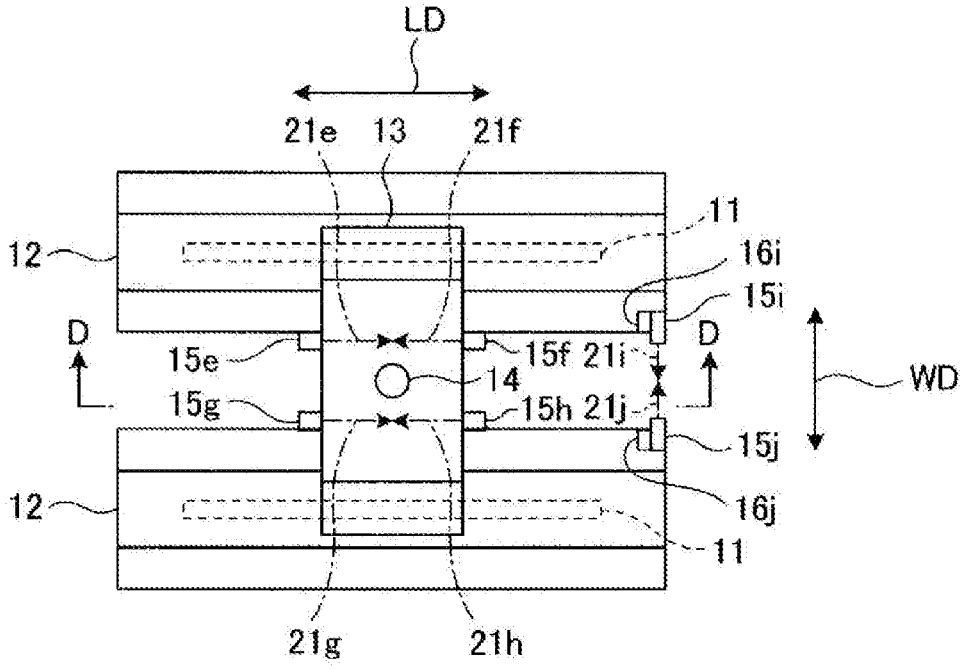
FIG. 8A is a top view illustrating still another exemplary embodiment (Example 4) of the infrared heating device according to the present invention.
Figure 8B:
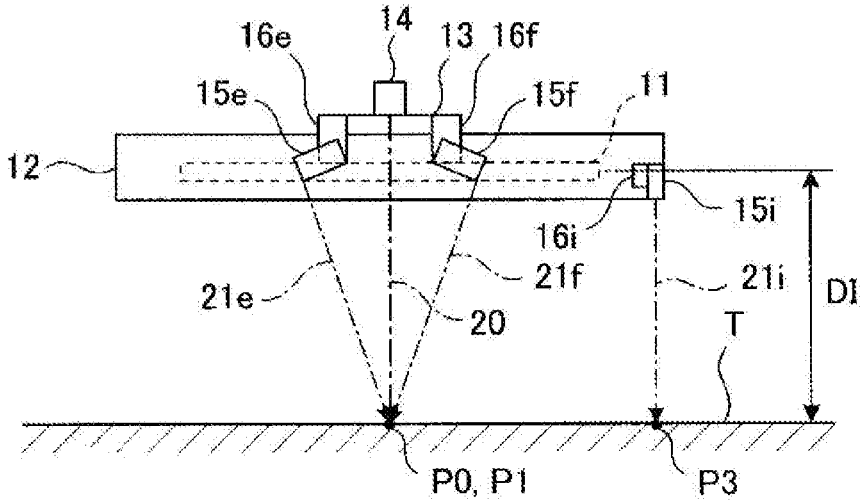
FIG. 8B is a diagram of the infrared heating device as viewed from an arrow direction of line D-D illustrated in FIG. 8A.
Figure 8C:
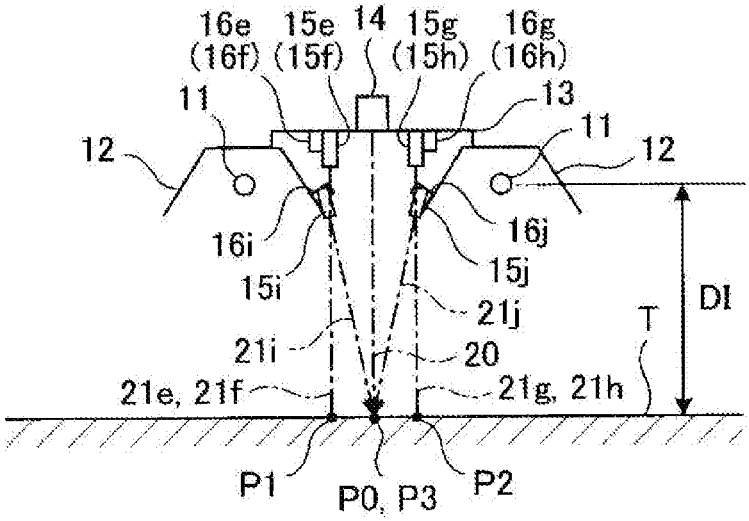
FIG. 8C is a side view of the infrared heating device illustrated in FIG. 8A.
Figure 9A:
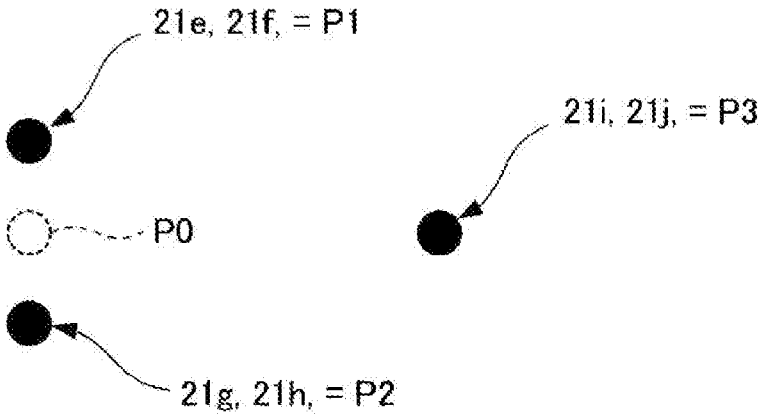
FIG. 9A is a diagram illustrating laser beams from laser pointers in a case of an appropriate position.
Figure 9B:
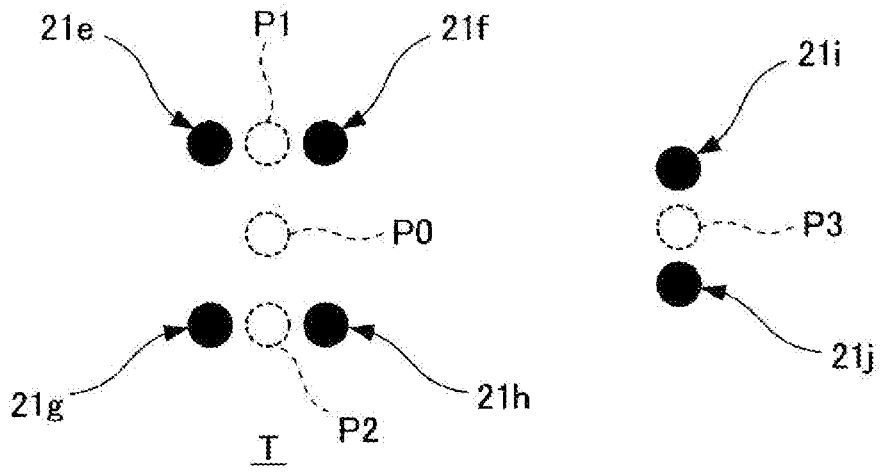
FIG. 9B is a diagram illustrating the laser beams from the laser pointers in a case of an inappropriate position.

FIG. 8A is a top view illustrating an infrared heating device according to the present Example, FIG. 8B is a diagram of the infrared heating device as viewed from an arrow direction of line D-D illustrated in FIG. 8A, and FIG. 8C is a side view of the infrared heating device illustrated in FIG. 8A. Further, FIG. 9A is a diagram illustrating laser beams from laser pointers in a case of an appropriate position, and FIG. 9B is a diagram illustrating the laser beams from the laser pointers in a case of an inappropriate position.

The infrared heating device according to the present Example also basically has a configuration equivalent to the configuration of the infrared heating device described in each of the above-described Examples 1 to 3. Therefore, in the present Example, components equivalent to the components of the infrared heating device described in each of the Examples 1 to 3 are denoted by the same reference numerals, and repetitive description thereof is omitted.

The infrared heating device according to the present Example includes another pair of laser pointers 15*i* and 15*j* (laser beam irradiation means) in addition to the two pairs of laser pointers 15*e*, 15*f*, 15*g*, and 15*h* in order to appropriately set the positions of the infrared lamps 11 and the radiation thermometer 14 relative to the object to be heated T.

The two pairs of laser pointers 15*e*, 15*f*, 15*g*, and 15*h* are attached in a manner similar to the Example 3. The other pair of laser pointers 15*i* and 15*j* are attached, through support plates 16*i* and 16*j*, to end parts on one side of the two reflectors 12 and on the inside of the two reflectors 12, so as to be arranged in surface symmetry with a surface that passes through the above-described measurement direction 20. Further, the support plates 16*i* and 16*j* respectively support the laser pointers 15*i* and 15*j* such that support angles of the laser pointers 15*i* and 15*j* are adjustable. With such a configuration, in addition to the laser pointers 15*e*, 15*f*, 15*g*, and 15*h*, the laser pointers 15*i* and 15*j* respectively irradiate laser beams 21*i* and 21*j* to the surface of the object to be heated T from different positions. Note that the laser pointers 15*i* and 15*j* may be attached to equivalent positions of the holding member 13 by, for example, changing the size or the shape of the holding member 13.

The other pair of laser pointers 15*i* and 15*j* are also respectively supported by the support plates 16*i* and 16*j* while the support angles of the laser pointers 15*i* and 15*j* are adjusted such that the laser beam 21*i* from the laser pointer 15*i* and the laser beam 21*j* from the laser pointer 15*j* are coincident in position with (intersect with) each other at a point P3 on the surface of the object to be heated T, in addition to positional coincidence of the laser beam 21*e* and the laser beam 21*f* at the point P1 on the surface of the object to be heated T and positional coincidence of the laser beam 21*g* and the laser beam 21*h* at the point P2 on the surface of the object to be heated T when the distance DI is the appropriate predetermined distance. In the case where it is necessary to change the appropriate predetermined distance based on the work contents, it is sufficient to change the appropriate predetermined distance by adjusting the support angles of the laser pointers 15*e*, 15*f*, 15*g*, 15*h*, 15*i*, and 15*j*.

As described above, in the present Example, the laser beam 21*e* and the laser beam 21*f* are made coincident in position with each other at the point P1 on the surface of the heated to be heated T, the laser beam 21*g* and the laser beam 21*h* are made coincident in position with each other at the other point P2 on the surface of the heated to be heated T, and the laser beam 21*i* and the laser beam 21*j* are made coincident in position with each other at the other point P3 on the surface of the object to be heated T. In other words, the distance DI is set to the appropriate predetermined distance at the three points P1, P2, and P3 different for each pair.

Accordingly, when the positions of the infrared lamps 11 and the reflectors 12 are adjusted by the arm, the link mechanism, or the like supporting the holding member 13 and the distance DI is the appropriate predetermined distance, the laser beam 21*e* and the laser beam 21*f* are coincident in position with each other at the point P1, the laser beam 21*g* and the laser beam 21*h* are coincident in position with each other at the point P2, and the laser beam 21*i* and the laser beam 21*j* are coincident in position with each other at the point P3, on the surface of the object to be heated T as illustrated in FIG. 9A. In contrast, when the distance DI is not the appropriate predetermined distance (distance is short or long), the laser beam 21*e* and the laser beam 21*f* are not coincident in position with each other, the laser beam 21*g* and the laser beam 21*h* are not coincident in position with each other, and the laser beam 21*i* and the laser beam 21*j* are not coincident in position with each other, on the surface of the object to be heated T as illustrated in FIG. 9B.

In other words, when the positions of the infrared lamps 11 and the reflectors 12 are adjusted to cause the laser beam 21*e* and the laser beam 21*f* to be coincident in position with each other at the point P1, to cause the laser beam 21*g* and the laser beam 21*h* to be coincident in position with each other at the point P2, and to cause the laser beam 21*i* and the laser beam 21*j* to be coincident in position with each other at the point P 3 on the surface of the object to be heated T, it is possible to easily adjust the distance DI to the appropriate predetermined distance without measuring the distance DI by a measurement device that measures a distance.

Further, since the distance DI is set to the appropriate predetermined distance at the three points P1, P2, and P3 on the surface of the object to be heated T, the infrared lamps 11 and the reflectors 12 are arranged in parallel to a plane formed by the point P1, the point P2, and the point P3 on the surface of the object to be heated T. In other words, the infrared lamps 11 and the reflectors 12 can be arranged in parallel to (main irradiation direction described above can be perpendicular to) the surface of the object to be heated T.

As described above, the distance DI can be set to the appropriate predetermined distance, and the infrared lamps 11 and the reflectors 12 are arranged in parallel to the plane on the surface of the object to be heated T. Accordingly, the output of the infrared lamps 11 in heating can be suppressed to an appropriate output, which makes it possible to reduce error of the radiation thermometer 14 and to control temperature with high accuracy. As a result, as with the Examples 1 to 3, it is possible to improve work efficiency in the coating drying and the sealant curing.

Note that the present invention may be configured by a combination of the configurations in the above-described Examples 1 and 2 and the configurations in the Examples 3 and 4.

INDUSTRIAL APPLICABILITY

The present invention is particularly suitable for coating drying and sealant curing of an aircraft.

REFERENCE SIGNS LIST

11 Infrared lamp
12 Reflector
13 Holding member
14 Radiation thermometer
15*a* to 15*j* Laser pointer
16*a* to 16*j* Support plate

The invention claimed is:

1. An infrared heating device, comprising:

a pair of infrared irradiators arranged in parallel along a longitudinal direction and irradiating infrared rays to an object to be heated to heat the object to be heated;

a holding member arranged between the pair of the infrared irradiators, the pair of the infrared irradiators being held by the holding member at respective opposite ends of the holding member;

a noncontact thermometer that is provided at a center of the holding member and measures temperature of a surface of the object to be heated;

a first pair of laser beam irradiators that irradiate laser beams to the surface of the object to be heated; and a pair of first support plates that support the first pair of laser beam irradiators, respectively, wherein the first pair of laser beam irradiators are attached, through the first support plates, to both outermost ends of the holding member in a direction parallel to the longitudinal direction, respectively, with the noncontact thermometer as a center, so as to be arranged in symmetry with each other about a plane passing through a measurement direction of the noncontact thermometer and orthogonal to the longitudinal direction, wherein the first pair of the laser beam irradiators is configured such that one of the laser beam irradiators forming the first pair of laser beam irradiators irradiates laser beams to the surface of the object to be heated from a position which is different than a position from which the other of the laser beam irradiators forming the first pair of laser beam irradiators irradiates laser beams, the first pair of laser beam irradiators are disposed to cause the respective laser beams to be coincident in position with each other at one point on the surface of the object to be heated when a distance between the surface of the object to be heated and the pair of infrared irradiators is a predetermined distance, wherein the infrared heating device further comprises a second pair of laser beam irradiators attached to the pair of the infrared irradiators through a pair of second support plates, respectively, wherein the second pair of laser beam irradiators and the second support plates are arranged at both outermost ends of the pair of infrared irradiators, respectively, the outermost ends being farthest from each other with respect to the pair of infrared irradiators in a direction perpendicular to the longitudinal direction, or at both innermost ends of the pair of infrared irradiators, respectively, the innermost ends being closest to each other with respect to the pair of infrared irradiators in the direction perpendicular to the longitudinal direction, wherein the second support plates support the second pair of laser beam irradiators, respectively, such that respective support angles of the second pair of laser beam irradiators are adjustable, wherein the predetermined distance between the surface of the object to be heated and the pair of infrared irradiators can be changed by changing the support angles of the second pair of laser beam irradiators, and wherein the first and second pairs of the laser beam irradiators are disposed to cause all of the laser beams to be coincident in position with one another at one point where the surface of the object to be heated and the measurement direction intersect with each other when the distance is the predetermined distance.

2. The infrared heating device according to claim 1, wherein the first support plates adjustably support the first pair of laser beam irradiators, respectively, such that respective support angles of the first pair of the laser beam irradiators are adjustable, and the predetermined distance between the surface of the object to be heated and the pair of infrared irradiators can be changed by changing the support angles of the first pair of the laser beam irradiators.

3. The infrared heating device according to claim 1, wherein each infrared irradiator of the pair of infrared irradiators includes an infrared lamp that emits infrared rays and a reflector that reflects the infrared rays from the infrared lamp, and at least one pair of laser beam irradiators is attached to the reflector.

4. The infrared heating device according to claim 1, wherein the holding member is movably supported by an arm or a link mechanism, and a distance between the surface of the object to be heated and the pair of infrared irradiators can be adjusted and the laser beams are made coincident in position with each other at one point on a surface of the subject to be heated, by adjusting a height position of the pair of infrared irradiators via the arm or the link mechanism.

5. The infrared heating device according to claim 1, wherein each infrared irradiator of the pair of infrared irradiators comprises a straight-tube infrared lamp.

6. The infrared heating device according to claim 5, wherein each straight-tube infrared lamp is arranged in parallel to an axis that passes through a plurality of points on the surface of the object to be heated, each of the plurality of points being a point where the laser beams are coincident in position with each other for each pair of the laser beam irradiators.

7. An infrared heating device, comprising:

a pair of infrared irradiators arranged in parallel along a longitudinal direction and irradiating infrared rays to an object to be heated to heat the object to be heated;

a holding member arranged between the pair of the infrared irradiators, the pair of the infrared irradiators being held by the holding member at respective opposite ends of the holding member;

a noncontact thermometer that is provided at a center of the holding member and measures temperature of a surface of the object to be heated;

a first pair of laser beam irradiators that irradiate laser beams to the surface of the object to be heated; and a pair of first support plates that support the first pair of laser beam irradiators, respectively, wherein the first pair of laser beam irradiators are attached, through the first support plates, to both outermost ends of the holding member in a direction parallel to the longitudinal direction, respectively, with the noncontact thermometer as a center, so as to be arranged in symmetry with each other about a plane passing through a measurement direction of the noncontact thermometer and orthogonal to the longitudinal direction, wherein the first pair of the laser beam irradiators is configured such that one of the laser beam irradiators forming the first pair of laser beam irradiators irradiates laser beams to the surface of the object to be heated from a position which is different than a position from which the other of the laser beam irradiators forming the first pair of laser beam irradiators irradiates laser beams, the infrared heating device further comprising a second pair of laser beam irradiators attached to the pair of the infrared irradiators through a pair of second support plates, respectively, wherein the second pair of laser beam irradiators and the second support plates are arranged at both outermost ends of the pair of infrared irradiators, the outermost ends being farthest from each other with respect to the pair of infrared irradiators in a direction perpendicular to the longitudinal direction, or at both innermost ends of the pair of infrared irradiators, the innermost ends being closest each other with respect to the pair of infrared irradiators in the direction perpendicular to the longitudinal direction, wherein the second support plates support the second pair of laser beam irradiators, respectively, such that respective support angles of the second pair of laser beam irradiators are adjustable, wherein the predetermined distance between the surface of the object to be heated and the pair of infrared irradiators can be changed by changing the support angles of the second pair of laser beam irradiators, and wherein the first and second pairs of the laser beam irradiators are disposed to cause the laser beams from the first pair of the laser beam irradiators to be coincident in position with one another at a first point on the surface of the object to be heated and to cause laser beams from the second pair of the laser beam irradiators to be coincident in position with one another at a second point on the surface of the object to be heated, wherein the first point and the second point are different points when the distance is the predetermined distance.

8. The infrared heating device according to claim 7, wherein each infrared irradiator of the pair of infrared irradiators includes an infrared lamp that emits infrared rays and a reflector that reflects the infrared rays from the infrared lamp, and at least one pair of laser beam irradiators is attached to the reflector.

9. The infrared heating device according to claim 7, wherein the holding member is movably supported by an arm or a link mechanism, and a distance between the surface of the object to be heated and the pair of infrared irradiators can be adjusted and the laser beams are made coincident in position with each other at one point on a surface of the subject to be heated, by adjusting a height position of the pair of infrared irradiators via the arm or the link mechanism.

10. The infrared heating device according to claim 7, wherein each infrared irradiator of the pair of infrared irradiators comprises a straight-tube infrared lamp.

11. An infrared heating device, comprising:

a pair of infrared irradiators arranged in parallel along a longitudinal direction and irradiating infrared rays to an object to be heated to heat the object to be heated;

a holding member arranged between the pair of the infrared irradiators, the pair of the infrared irradiators being held by the holding member at respective opposite ends of the holding member;

a noncontact thermometer that is provided at a center of the holding member and measures temperature of a surface of the object to be heated;

a first pair of laser beam irradiators that irradiate laser beams to the surface of the object to be heated; and a pair of first support plates that support the first pair of laser beam irradiators, respectively, wherein the first pair of laser beam irradiators are attached, through the first support plates, to both outermost ends of the holding member in a direction parallel to the longitudinal direction, respectively, with the noncontact thermometer as a center, so as to be arranged in symmetry with each other about a plane passing through a measurement direction of the noncontact thermometer and orthogonal to the longitudinal direction, wherein the first pair of the laser beam irradiators is configured such that one of the laser beam irradiators forming the first pair of laser beam irradiators irradiates laser beams to the surface of the object to be heated from a position which is different than a position from which the other of the laser beam irradiators forming the first pair of laser beam irradiators irradiates laser beams, the infrared heating device further comprising a second pair of laser beam irradiators attached to the holding member through a pair of second support plates, respectively, wherein the second pair of laser beam irradiators are attached, through the second support plates, to both outermost ends of the holding member in a direction parallel to the longitudinal direction, respectively, with the noncontact thermometer as a center, so as to be arranged in symmetry with each other about a plane passing through the measurement direction of the noncontact thermometer and orthogonal to the longitudinal direction, wherein the second support plates adjustably support the second pair of laser beam irradiators, respectively, such that respective support angles of the second pair of the laser beam irradiators are adjustable, wherein the predetermined distance between the surface of the object to be heated and the pair of infrared irradiators can be changed by changing the support angles of the second pair of the laser beam irradiators, and wherein the first and second pairs of the laser beam irradiators are disposed to cause the laser beams from the first pair of the laser beam irradiators to be coincident in position with one another at a first point on the surface of the object to be heated and to cause laser beams from the second pair of the laser beam irradiators to be coincident in position with one another at a second point on the surface of the object to be heated, wherein the first point and the second point are different points when the distance is the predetermined distance.

12. The infrared heating device according to claim 11, further comprising a third pair of laser beam irradiators attached to the pair of the infrared irradiators through a pair of third support plates, respectively, wherein the third pair of laser beam irradiators and the third support plates are arranged at both outermost ends of the pair of infrared irradiators, the outermost ends being farthest from each other with respect to the pair of infrared irradiators in a direction perpendicular to the longitudinal direction, or at both innermost ends of the pair of infrared irradiators, the innermost ends being closest each other with respect to the pair of infrared irradiators in the direction perpendicular to the longitudinal direction, wherein the third support plates adjustably support the third pair of laser beam irradiators, respectively, such that respective support angles of the third pair of the laser beam irradiators are adjustable, wherein the predetermined distance between the surface of the object to be heated and the pair of infrared irradiators can be changed by changing the support angles of the third pair of the laser beam irradiators, and wherein the first, second and third pairs of the laser beam irradiators are disposed to cause laser beams from the third pair of the laser beam irradiators to be coincident in position with one another at a third point on the surface of the object to be heated, wherein the third point is a different point from the first and second points when the distance is the predetermined distance.

13. The infrared heating device according to claim 11, wherein each infrared irradiator of the pair of infrared irradiators includes an infrared lamp that emits infrared rays and a reflector that reflects the infrared rays from the infrared lamp, and at least one pair of laser beam irradiators is attached to the reflector.

14. The infrared heating device according to claim 11, wherein the holding member is movably supported by an arm or a link mechanism, and a distance between the surface of the object to be heated and the pair of infrared irradiators can be adjusted and the laser beams are made coincident in position with each other at one point on a surface of the subject to be heated, by adjusting a height position of the pair of infrared irradiators via the arm or the link mechanism.

15. The infrared heating device according to claim 11, wherein each infrared irradiator of the pair of infrared irradiators comprises a straight-tube infrared lamp.

* * * * *